US007304532B2

(12) United States Patent
Kim et al.

(10) Patent No.: US 7,304,532 B2
(45) Date of Patent: Dec. 4, 2007

(54) VOLTAGE REFERENCE GENERATOR WITH FLEXIBLE CONTROL OF VOLTAGE

(75) Inventors: Hyo-Jin Kim, Suwon-Si (KR); Yoon-Jay Cho, Seoul (KR); Jeong-Seok Chae, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 134 days.

(21) Appl. No.: 11/203,623

(22) Filed: Aug. 12, 2005

(65) Prior Publication Data

US 2006/0061413 A1 Mar. 23, 2006

(30) Foreign Application Priority Data

Sep. 18, 2004 (KR) ..... 10-2004-0074821

(51) Int. Cl.
*G05F 1/10* (2006.01)

(52) U.S. Cl. ..... 327/543; 327/525

(58) Field of Classification Search ..... 323/315, 323/316, 317; 327/525, 538, 543
See application file for complete search history.

(56) References Cited

U.S. PATENT DOCUMENTS 4,608,530 A * 8/1986 Bacrania ..... 323/315
5,608,348 A * 3/1997 Kearney et al. ..... 327/538
5,949,278 A 9/1999 Oguey ..... 327/543
6,140,862 A * 10/2000 Hagura ..... 327/537
6,297,624 B1 * 10/2001 Mitsui et al. ..... 323/316
6,337,597 B2 * 1/2002 Fujikawa ..... 327/538
6,441,680 B1 8/2002 Leung et al. ..... 327/541
6,462,527 B1 * 10/2002 Maneatis ..... 323/315

OTHER PUBLICATIONS

Korean Patent Application No. 1019980024142 to Kim, having Publication date of Jan. 15, 2000 (w/ English Abstract page).
Korean Patent Application No. 1020000064442 to Park, having Publication date of May 9, 2002 (w/ English Abstract page).

* cited by examiner

*Primary Examiner*—Jeffrey Zweizig
(74) *Attorney, Agent, or Firm*—Monica H. Choi

(57) ABSTRACT

A voltage reference generator includes a current source for generating a source current in response to a control voltage and a current sink for conducting the source current to generate a reference voltage. Additionally, a switch block is configurable to determine the level of the source current conducted through the current sink. Furthermore, a reference current generator includes transistors operating in weak inversion with an active load coupled to one of the transistors.

16 Claims, 2 Drawing Sheets

VOLTAGE REFERENCE GENERATOR WITH FLEXIBLE CONTROL OF VOLTAGE

BACKGROUND OF THE INVENTION

This application claims priority to Korean Patent Application No. 2004-74821, filed on Sep. 18, 2004, in the Korean Intellectual Property Office, the disclosure of which is incorporated herein in its entirety by reference.

1. Field of the Invention

The present invention relates generally to voltage reference generators, and more particularly, to a voltage reference generator with flexible control of the generated voltage.

2. Description of the Related Art

Silicon which may be a conductor or a nonconductor is frequently used for fabricating a semiconductor device. With impurities such as donors or accepters doping silicon, movable electrical charges (i.e. electrons or holes) are generated in the silicon to determine the electrical property of the semiconductor device.

Ion implantation or deposition is used for doping the silicon with such impurities. In addition, electrons and holes are continuously generated and extinguished in the semiconductor device. For example, if the semiconductor absorbs sufficient energy, electron-hole pairs are generated. Such generated electron-hole pairs are subsequently extinguished by recombination after an elapse of time.

Such generation and extinction of the electron-hole pairs result in leakage current of at least several micro-amperes (μA) or more in an integrated circuit. Such leakage current is difficult to eliminate, and the level of such leakage current is difficult to predict. For low power integrated circuits, such leakage current must be considered during the design.

A voltage reference generator is commonly used in integrated circuits for providing a reference voltage that is constant irrespective of a variation in a supply voltage, temperature, or manufacturing process. For example, the voltage reference generator is commonly used in an analog-to-digital converter (ADC) and a digital-to-analog converter (DAC). In particular, as systems are desired to consume low power, the voltage reference generator is also desired to consume low power.

A conventional voltage reference circuit generates a reference voltage from an energy band gap of silicon. However, for low power consumption at low levels of current, leakage current becomes significant compared with the level of current in the voltage reference circuit.

FIG. 1 is a schematic diagram of a conventional voltage reference circuit. The voltage reference circuit of FIG. 1 includes a current source 10 for supplying a reference current $I_{ref}$ and a current sink 20 for generating a reference voltage $V_{ref}$ corresponding to the reference current $I_{ref}$. The reference voltage $V_{ref}$ generated by the current sink 20 is also determined by physical properties of the current sink 20. In the example of FIG. 1, the current sink 20 is an NMOSFET (N-channel metal oxide semiconductor field effect transistor), and the physical properties of the current sink 20 includes a ratio (W/L) of a gate width (W) to a gate length (L) of the NMOSFET 20, as determined during fabrication of the NMOSFET 20.

FIG. 2 is a schematic diagram of a conventional voltage reference circuit using MOSFETs (metal oxide semiconductor field effect transistors) in weak inversion. Referring to FIG. 2, a voltage reference circuit 200 includes two NMOSFETs N1 and N2 operating in weak inversion to generate a reference voltage $V_{REF}$ that is substantially constant with temperature.

When a resistance R1 is properly adjusted, the two NMOSFETs N1 and N2 operate in weak inversion. The two NMOSFETs N1 and N2 and thus the voltage reference circuit 200 consume considerably less power than the prior art. Since operation of the voltage reference circuit 200 is known to one of ordinary skill in the art, generation of the reference voltage $V_{REF}$ is now described.

Referring to FIG. 2, the reference voltage $V_{REF}$ is expressed as the sum ($V_{R2}$+$V_{N3}$). $V_{R2}$ is the voltage across a resistor R2, and $V_{N3}$ is a gate to source voltage in an NMOSFET N3.

The voltage $V_{R2}$ is expressed as the following Equation (1):

$$V_{R2} = \frac{R2}{R1} n U_T \ln(S) \tag{1}$$

Here, R1 and R2 are resistances of the two resistors as illustrated in FIG. 2, and 'n' is a sub-threshold swing factor of the NMOSFET N3. $U_T$ is a thermal voltage having a value of 26 milli-volts (mV) at ambient temperature. A constant S is determined by the ratio $$\left(\frac{W_1}{L_1}\right)$$

of a gate width ($W_1$) to a gate length ($L_1$) of the NMOSFET N1 and the ratio $$\left(\frac{W_2}{L_2}\right)$$

of a gate width ($W_2$) to a gate length ($L_2$) of the NMOSFET N2 as expressed in the following Equation (2):

$$\frac{W_1}{L_1} : \frac{W_2}{L_2} = S:1 \tag{2}$$

In the Equation (1) above, the voltage $V_{R2}$ across the resistor R2 is proportional to absolute temperature. On the other hand, the gate to source voltage $V_{N3}$ of the NMOSFET N3 is inversely proportional to absolute temperature. Accordingly, the reference voltage $V_{REF}$ can be controlled to be constant irrespective of temperature by properly adjusting the voltages $V_{R2}$ and $V_{N3}$.

The conventional voltage reference circuit 200 may operate with low current and thereby low power dissipation. However, for such low power operation, the resistances R1 and/or R2 may be relatively high such as several kilo-ohms (KΩ) to several mega-ohms (MΩ). However, such a high resistance occupies a large area of an integrated circuit, and the resistance value may be difficult to control.

SUMMARY OF THE INVENTION

Accordingly, a voltage reference generator of the present invention provides a reference voltage with flexible control of the reference voltage and with low power consumption without a resistor.

A voltage reference generator according to an aspect of the present invention includes a current source for generating a source current in response to a control voltage. In addition, the voltage reference generator includes a current sink for conducting the source current to generate a reference voltage. Additionally, a switch block is coupled between the current source and the current sink and is configurable to determine the level of the source current conducted through the current sink.

In one embodiment of the present invention, the switch block is comprised of a plurality of fuses, and a number of the fuses that are opened determines the level of the source current conducted through the current sink.

In a voltage reference generator according to another aspect of the present invention, a reference current generator for generating the control voltage includes a current mirror of two transistors operating in weak inversion. The reference current generator also includes an active load coupled to one of the transistors and formed by another transistor operating in strong inversion.

In this manner, with operation of transistors in weak inversion, the voltage reference generator has low power consumption and generates a reference voltage that is independent of temperature. In addition, by using an active load, the transistors operate in weak inversion without use of a resistor. The switching block is used to flexibly adjust the reference voltage level even after fabrication of the voltage reference generator.

BRIEF DESCRIPTION OF THE DRAWINGS

The above and other features and advantages of the present invention will become more apparent when described in detailed exemplary embodiments thereof with reference to the attached drawings in which.

The figures referred to herein are drawn for clarity of illustration and are not necessarily drawn to scale. Elements having the same reference number in FIGS. 1, 2, and 3 refer to elements having similar structure and/or function.

DETAILED DESCRIPTION OF THE INVENTION

Figure 3:
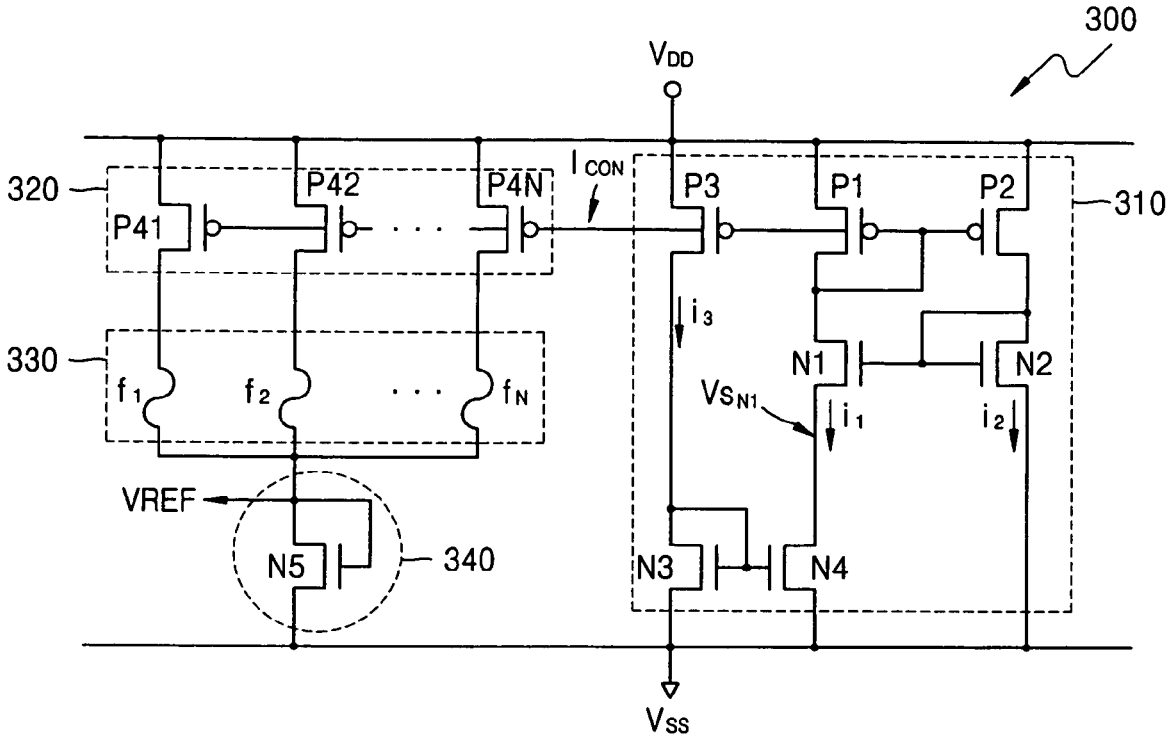
FIG. 3 is a circuit diagram of a voltage reference generator according to an embodiment of the present invention.

FIG. 3 shows a circuit diagram of a voltage reference generator 300 according to an embodiment of the present invention. Referring to FIG. 3, the voltage reference generator 300 includes a reference current generator 310, a current source 320, a switch block 330, and a current sink 340.

The reference current generator 310 includes three PMOSFETs (P-channel metal oxide semiconductor field effect transistors) P1, P2, and P3 and four NMOSFETs (N-channel metal oxide semiconductor field effect transistors) N1, N1, N3, and N4. The MOSFETs of the reference current generator 310 are configured to generate a constant reference current that is not affected by supply voltages VDD and VSS and temperature.

In addition, the reference current generator 310 generates a control voltage $I_{con}$ at the gates of the PMOSFETs P1, P2, and P3 that are coupled together. The control voltage $I_{con}$ determines the reference current through the current source 320. The reference current generator 310 is described in U.S. Pat. No. 5,949,278 to Oguey.

The current source 320 generates a current corresponding to the control voltage $I_{con}$ to the current sink 340 through the fuse block 330. In one embodiment of the present invention, the current source 320 includes a plurality of PMOSFETs P41, P42, . . . , and P4N having gates that are coupled together with the control voltage $I_{con}$ applied thereon. The sources of the PMOSFETs P41, P42, . . . , and P4N are coupled to a high supply voltage $V_{DD}$. A respective drain of each of the PMOSFETs P41, P42, . . . , and P4N is coupled to an end of a respectively one of fuses $f_1$, $f_2$, . . . , and $f_N$ within the switching block 330 that is a fuse block.

The other end of the fuses $f_1$, $f_2$, . . . , and $f_N$ is each coupled to a drain of an NMOSFET N5 of the current sink 340. The number of the fuses $f_1$, $f_2$, . . . , and $f_N$ that are opened within the fuse block 330 determines a level of the source current conducted through the current sink 340.

The number of the fuses $f_1$, $f_2$, . . . , and $f_N$ that are opened may be determined during fabrication of the voltage reference generator 300. Alternatively, the number of the fuses $f_1$, $f_2$, . . . , and $f_N$ that are opened may be determined after fabrication of the voltage reference generator 300. A fuse may be opened by electrical heat or laser heat. A fuse that is opened disconnects a respective one of the PMOSFETs P41, P42, . . . , and P4N from the current sink 340.

Alternatively, the voltage reference generator 300 may also be implemented with one MOSFET replacing the current source 320 and the fuse block 330. In that case, the gate width and length are properly designed to determine the reference current conducted through the current sink 340. In any case, the current sink 340 generates a reference voltage $V_{REF}$ corresponding to the level of the source current from the current source 320 and conducted through the fuse block 330 and the current source 320.

An operation of the voltage reference generator 300 is now described. Referring to FIG. 3, a low current of 5 nano-amperes (nA) to 500 nano-amperes flows in the reference current generating circuit 310. The NMOSFETs N1 and N2 are biased to operate in weak inversion by adjusting the conductance of the NMOSFET N4. The PMOSFETs P1, P2, and P3 and the NMOSFET N3 operate in strong inversion within a saturation region. The NMOSFET N4 operates in strong inversion within a linear region.

The PMOSFETs P1 and P2 form a current mirror, and the NMOSFETs N3 and N4 form another current mirror. A source voltage of the NMOSFET N1 is determined by the sizes of the NMOSFETs N1 and N2. Here, "size" means the ratio W/L of a gate width W to a gate length L.

When the PMOSFETs P1 and P2 have the same size, a source voltage $Vs_{N1}$ of the NMOSFET N1 is expressed as the following Equation (3):

$$Vs_{N1} = nU_T \ln\left[\frac{S_{P2}S_{N1}}{S_{P1}S_{N2}}\right] \tag{3}$$

Here, $S_{N1}$ is the ratio of a gate width to a gate length of the NMOSFET N1, $S_{N2}$ is the ratio of a gate width to a gate length of the NMOSFET N2, $S_{p1}$ is the ratio of a gate width to a gate length of the PMOSFET P1, and $S_{P2}$ the ratio of a gate width to a gate length of the PMOSFET P2. n is a sub-threshold swing factor, and $U_T$ is a thermal voltage.

The source voltage $VS_{N1}$ of the NMOSFET N1 is controlled by adjusting an on-resistance of the NMOSFET N4. The conductance of the NMOSFET N4 varies with temperature.

A current $i_1$ flowing in the NMOSFET N4 operating in strong inversion within the linear region and a current $i_3$ flowing in the NMOSFET N3 operating in strong inversion within the saturation region are respectively expressed as the following Equations (4) and (5):

$$i_3 = \frac{1}{2}\beta_{N3}(Vg_{N3} - Vth_{N3})^2 \tag{4}$$

$$i1 = \beta_{N4}V_{SN1}\left(V_{gN4} - Vth_{N4} - \frac{1}{2}V_{SN1}\right),\ V_{SN1} = nU_T\ \ln\left(\frac{S_{N1}}{S_{N2}}\right) \tag{5}$$

When the PMOSFETs P1 and P2 have a same size, $i_1 = i_3$ such that $i_1$ can be rewritten as the following Equation (6):

$$i_1 = I_{ref} = n^2\beta_{N4}U_T^2K_{eff} \tag{6}$$

$$K_{eff} = \left\{K_2 - 0.5 + \sqrt{K_2(K_2 - 1)}\right\}\ \ln^2(K_1)$$

$$K_1 = \frac{S_{N1}S_{P2}}{S_{N2}S_{P1}},\ K_2 = \frac{S_{N4}S_{P3}}{S_{N3}S_{P1}}$$

Here, $S_{P3}$ is the ratio of a gate width to a gate length of the PMOSFET P3. A current-voltage characteristic equation of a general MOSFET operating in saturation is expressed as the following Equation (7):

$$I_{DS} = \beta(V_{gs} - V_{th})^2 \tag{7}$$

Figure 1:
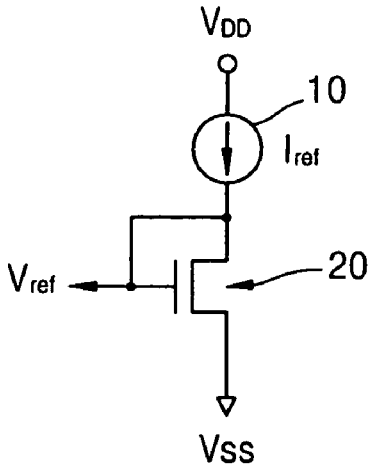
FIG. 1 (PRIOR ART)
FIG. 1 is a circuit diagram of a general voltage reference circuit according to the prior art.
Figure 2:
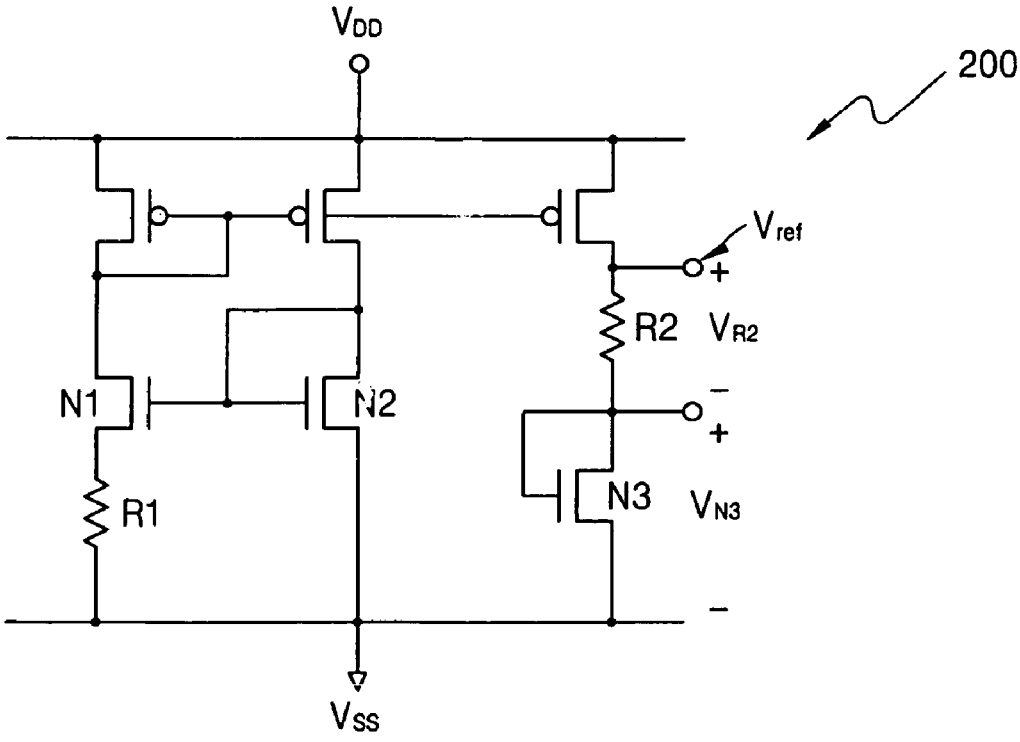
FIG. 2 (PRIOR ART)
FIG. 2 is a circuit diagram of a conventional voltage reference circuit with NMOSFETs operation in weak inversion.

From the Equation (7), the reference voltage $V_{ref}$ shown in FIG. 1 can be expressed as the following Equation (8):

$$V_{ref} = \sqrt{\frac{I_{ref}}{\beta}} + V_{th} \tag{8}$$

A threshold voltage $V_{th}$ of an MOSFET linearly decreases with increasing temperature. Assuming that a temperature variation coefficient is α, the reference voltage $V_{ref}$ can be rewritten as the following Equation (9):

$$V_{ref} = \sqrt{\frac{I_{ref}}{\beta}} + Vth|_{T=T0} - \alpha(T - T0) \tag{9}$$

If the $$\sqrt{\frac{I_{ref}}{\beta}}$$

term in the Equation (9) compensates for the temperature variation of the threshold voltage, the reference voltage $V_{ref}$ is not sensitive to temperature. That is, since a threshold voltage linearly decreases as temperature increases, $$\sqrt{\frac{I_{ref}}{\beta}}$$

should be adjusted to linearly increase as temperature increases.

Since the mobility β of a MOSFET is proportional to temperature, a reference current $I_{ref}$ should be proportional to the square of temperature so that $$\sqrt{\frac{I_{ref}}{\beta}}$$

is proportional to temperature.

The reference current $I_{ref}$ can be more accurately expressed as the following Equation (10):

$$i_1 = I_{ref} = n^2\beta_{N4}\left(\frac{KT}{q}\right)^2K_{eff} \tag{10}$$

The reference current $I_{ref}$ is proportional to the square of temperature T as shown in the Equation (10), and thus the above condition is satisfied.

Developing the reference current $I_{ref}$ shown in the Equation (6) by using the Equation (9), the reference voltage $V_{REF}$ can be expressed as the following Equation (11).

$$V_{REF} = \left(\frac{S_{P3}}{S_{P1}}\right)^{0.5}\sqrt{\frac{2i}{\beta_{N5}}} + V_{TH} \tag{11}$$

$$V_{REF} = \left(2n^2U_T^2K\frac{\beta_{N3}S_{P3}}{\beta_{N5}S_{P1}}\right)^{1/2} + V_{TH}$$

$$\frac{\partial V_{REF}}{\partial T} = \frac{k}{q}\left(2n^2K\frac{\beta_{N3}S_{P3}}{\beta_{N5}S_{P1}}\right)^{1/2} - \alpha = 0$$

As shown in the Equation (11), by adjusting the sizes the MOSFETs in the reference voltage generator 300, the reference voltage $V_{REF}$ that is constant irrespective of temperature may be obtained.

In addition, referring to FIG. 3, the level of the source current $I_{ref}$ conducted through the current sink N5 is controlled by the number of fuses opened within the fuse block 330. Parameters such as threshold voltage and mobility of MOSFETs may be difficult to control during fabrication of the reference current generator 300. Thus, the fuse block 330 is used according to the present invention for adjusting for such uncontrollable parameter variations. Such adjustment may be made during or after fabrication of the voltage reference generator 300.

In this manner, with operation of NMOSFETs N1 and N2 in weak inversion, the voltage reference generator 300 has low power consumption and generates a reference voltage that is independent of temperature. In addition, by using an active load N3, the NMOSFETs N1 and N2 operate in weak inversion without use of a resistor. The fuse block 330 is used to flexibly adjust the reference voltage level even after fabrication of the voltage reference generator.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A voltage reference generator comprising:

a current source for generating a source current in response to a control voltage, wherein the current source includes a plurality of transistors;

a current sink for conducting the source current to generate a reference voltage, wherein the current sink is comprised of one transistor that conducts only the entire source current generated by all of the transistors of the current source; and a switch block that is coupled between the current source and the current sink and that is configurable to determine a level of the source current conducted through the current sink, and wherein the switch block is comprised of a plurality of fuses;

and wherein any current path formed through the current source, the current sink, and the switch block is a respective serial connection of only a high supply voltage, a respective one transistor of the current source, a respective one of the fuses, the one transistor of the current sink, and a low supply voltage.

2. The voltage reference generator of claim 1, wherein a number of the fuses that are opened determines the level of the source current conducted through the current sink.

3. The voltage reference generator of claim 2, wherein the number of the fuses that are opened is determined after fabrication of the voltage reference generator.

4. The voltage reference generator of claim 2, wherein the number of the fuses that are opened is determined during fabrication of the voltage reference generator.

5. The voltage reference generator of claim 2, wherein each transistor in the current source is coupled to one end of a respective fuse and has a gate with the control voltage applied thereon.

6. The voltage reference generator of claim 1, further comprising:

a reference current generator for generating the control voltage.

7. The voltage reference generator of claim 6, wherein the reference current generator includes:

a current mirror of two NMOSFETs (N-channel metal oxide semiconductor field effect transistors) operating in weak inversion; and an active load coupled to a source of one of the NMOSFETs and formed by another transistor operating in strong inversion.

8. The voltage reference generator of claim 7, wherein the reference current generator includes:

a current mirror of two PMOSFETs (P-channel metal oxide semiconductor field effect transistors) operating in strong inversion and coupled to the current mirror of the NMOSFETs;

wherein gates of the PMOSFETs generate the control voltage.

9. A voltage reference generator comprising:

a current source for generating a source current in response to a control voltage, wherein the current source includes a plurality of transistors;

a current sink for conducting the source current to generate a reference voltage, wherein the current sink is comprised of one transistor that conducts only the entire source current generated by all of the transistors of the current source;

a switch block that is coupled between the current source and the current sink and that is configurable to determine a level of the source current conducted through the current sink, and wherein the switch block is comprised of a plurality of fuses;

and wherein any current oath formed through the current source, the current sink, and the switch block is a respective serial connection through only a high supply voltage, a respective one transistor of the current source, a respective one of the fuses, the one transistor of the current sink, and a low supply voltage; and a reference current generator for generating the control voltage and including:

a current mirror of two transistors operating in weak inversion; and an active load coupled to one of the transistors and formed by another transistor operating in strong inversion.

10. The voltage reference generator of claim 9, wherein the two transistors of the current mirror and the active load are each an NMOSFET (N-channel metal oxide semiconductor field effect transistor).

11. The voltage reference generator of claim 10, wherein the reference current generator further includes:

a current mirror of two PMOSFETs (P-channel metal oxide semiconductor field effect transistors) operating in strong inversion and coupled to the current mirror of the NMOSFETs;

wherein gates of the PMOSFETs generate the control voltage.

12. The voltage reference generator of claim 9, wherein a number of the fuses that are opened determines the level of the source current conducted through the current sink.

13. The voltage reference generator of claim 12, wherein the number of the fuses that are opened is determined after fabrication of the voltage reference generator.

14. The voltage reference generator of claim 12, wherein the number of the fuses that are opened is determined during fabrication of the voltage reference generator.

15. The voltage reference generator of claim 12, wherein each transistor in the current source is coupled to one end of a respective fuse and has a gate with the control voltage applied thereon.

16. A voltage reference generator comprising:

a current source for generating a source current in response to a control voltage, wherein the current source includes a plurality of transistors;

a current sink for conducting the source current to generate a reference voltage, wherein the current sink is comprised of one transistor that conducts only the entire source current generated by all of the transistors of the current source;

a switch block that is coupled between the current source and the current sink and that is configurable to determine a level of the source current conducted through the current sink, and wherein the switch block is comprised of a plurality of fuses;

and wherein any current path formed through the current source, the current sink, and the switch block is a respective serial connection of only a high supply voltage, a respective one transistor of the current source, a respective one of the fuses, the one transistor of the current sink, and a low supply voltage; and means for generating the control voltage with a current mirror of two transistors operating in weak inversion and without using a resistor.

* * * * *